US005687785A

United States Patent [19]

Erber et al.

[11] Patent Number: 5,687,785

[45] Date of Patent: Nov. 18, 1997

[54] VENETIAN BLIND SLAT

[75] Inventors: Gunther Erber, Ebental; Andreas Erber, Feldgasse 31, A-9065 Ebental (Kärnten), both of Austria

[73] Assignee: Andreas Erber, Ebental, Austria

[21] Appl. No.: 666,510

[22] PCT Filed: Dec. 29, 1994

[86] PCT No.: PCT/AT94/00206

§ 371 Date: Jun. 27, 1996

§ 102(e) Date: Jun. 27, 1996

[87] PCT Pub. No.: WO95/18285

PCT Pub. Date: Jul. 6, 1995

[30] Foreign Application Priority Data

| | | | |
|---|---|---|---|
| Dec. 30, 1993 | [AT] | Austria | 2648/93 |
| May 20, 1994 | [AT] | Austria | 1039/94 |
| Dec. 9, 1994 | [AT] | Austria | 2289/94 |

[51] Int. Cl.[6] ..... E06B 3/12

[52] U.S. Cl. ..... 160/236; 160/232

[58] Field of Search ..... 160/236, 232, 160/178.3 R, 133, 173 R; 49/92.1

[56] References Cited

U.S. PATENT DOCUMENTS

| | | | |
|---|---|---|---|
| 3,302,692 | 2/1967 | Grau | 160/133 |
| 4,625,868 | 12/1986 | Bischof | 160/236 X |
| 5,435,371 | 7/1995 | Cheng | 160/133 |
| 5,566,737 | 10/1996 | Erber | 160/133 |

*Primary Examiner*—David M. Purol
*Attorney, Agent, or Firm*—Young & Thompson

[57] ABSTRACT

A roller shutter slat has hollow sectional slats (1) with a central part (1*c*), two edge parts (1*a*) and transverse grooves (1*b*) arranged therebetween for receiving bearing or adjusting links (3, 4). The edge parts (1*a*) and the central parts (1*c*) are spaced apart and interconnected by linking elements (5, 6, 40, 41) inserted into hollow chambers (26) of the hollow sectional slat (1). The cross-section of the linking elements (5, 6, 40, 41) is narrower than the cross-section of the hollow chambers (26) and the linking elements (5, 6, 40, 41) are linked to the hollow sectional slats (1) by tongue-and-groove joints (9, 10; 42, 43). Easy-to-produce grooves (1*b*) are thus created without weakening the roller shutter slat (1) in the area of the grooves (1*b*).

9 Claims, 4 Drawing Sheets

FIG. 14
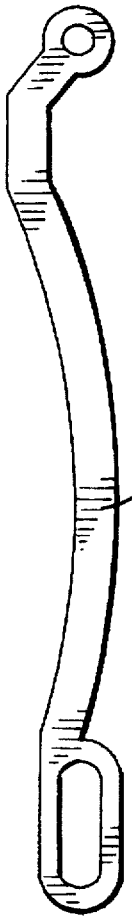
FIG. 13
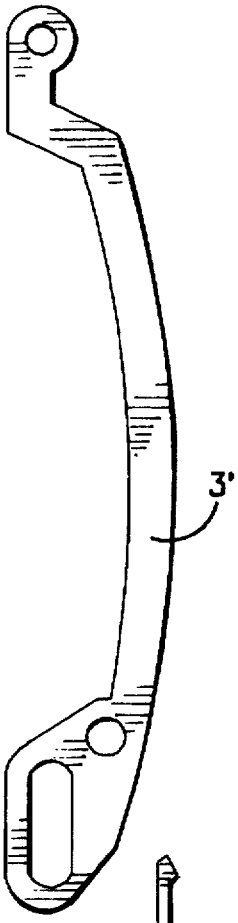
FIG. 12
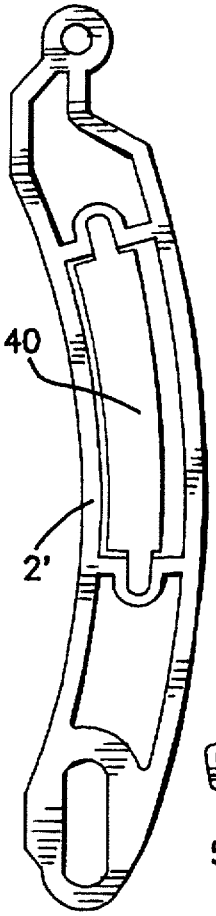
FIG. 11
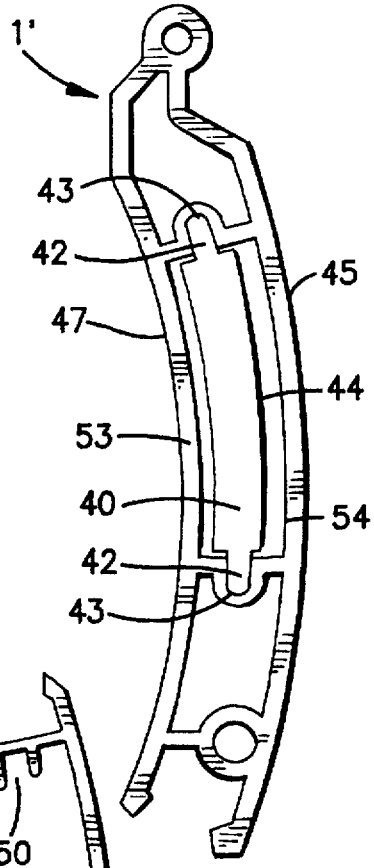
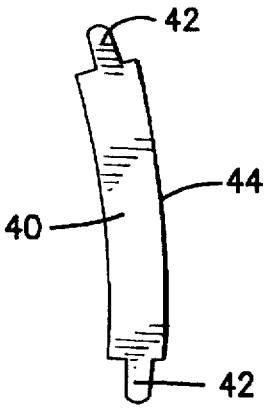
FIG. 15
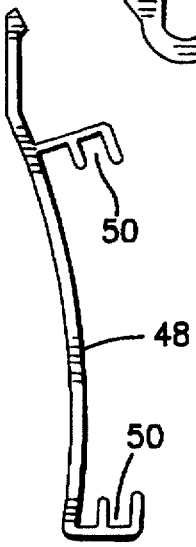
FIG. 17
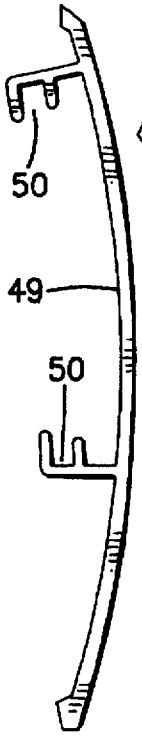
FIG. 18
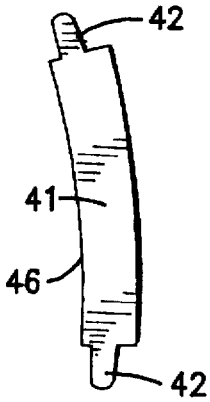
FIG. 16

VENETIAN BLIND SLAT

FIELD OF THE INVENTION

The invention relates to a Venetian blind slat which is made as a hollow section slat and which has grooves to hold chain links transversely to its longitudinal extension, in which a joining element for joining two parts of the hollow section slat can be inserted into a hollow chamber of the latter.

BACKGROUND OF THE INVENTION

WO 93/21417 and EP-A-189 091 disclose Venetian blind systems in which in the Venetian blind slats transversely to the longitudinal extension of the slats there are grooves or recesses in order to form free spaces for adjustable or support chain links. These grooves are produced for example by routing from the profiled Venetian blind slat. In this structure relatively few parts are necessary, but production of these grooves or recesses is time-consuming and expensive. Another disadvantage is that a conflict arises in that the cross section of the Venetian blind slat which remains in the area of the groove or recesses should not be too weak so that the Venetian blind retains enough strength. i.e., that the wall thicknesses of the Venetian blind slat made as a hollow section must be relatively great; however, this leads to relatively high weight of the Venetian blind slat and increases its costs; however this does not increase the stiffness of the section to the desired degree.

Therefore the object of the invention is to make available a Venetian blind which can be cost favorably produced, but which has high enough strength without being unnecessarily heavy.

This object is achieved in a generic Venetian blind by spacing the two parts of the hollow profiled slat away from one another and bordering the groove with the joining element.

EP-A-189 091 does disclose joining parts of the Venetian blind slats via peg parts which are inserted into the hollow section chamber. These peg parts however are not used where support or adjustable chain links are to be accommodated in the Venetian blind slat.

SUMMARY OF THE INVENTION

These problems are easily solved by the joining element according to the invention, since in the area of the support or adjustable chain links the Venetian blind slat itself is not weakened, but is replaced by a stable joining element.

In the production of the Venetian blind the advantage also arises that the individual parts, i.e., the adjustable chain links, the joining elements, the support and adjustable chain links can be cut off by straight cuts and thus in a package, by which not only the machinery for producing the Venetian blind can be technically less complex and thus cheaper, but working times can also be shortened. The Venetian blind slats and joining elements after cutting off straight need only be pushed into one another and joined securely to one another for example by notch pressing or adhesives.

Directly at the joining site, where for example a tension or adjustable chain link is to be accommodated, the Venetian blind slat is made partially as a solid slat. The joining element is made as a solid slat and not as a hollow profiled slat, and it is thus somewhat heavier. But for this reason the Venetian blind slat in this area in which it is weakened in the known embodiments, has especially high strength. Since, conventional Venetian blinds have a greater width and the remainder of the Venetian blind slat can be made especially light and thin-walled, by means of the invention significant weight can be saved without the Venetian blind slat losing strength.

If the joining element essentially completely fills the hollow chamber in the hollow profiled slat, this limits the wall thickness of the tension or adjustable chain links to at most the wall thickness of the Venetian blind slats. Since at low wall thicknesses of the Venetian blind slats the support or adjustable chain links can only be made weak, in some cases strength problems can arise in support and adjustable chain links.

One preferred development of the invention is therefore characterized by the fact that the cross section of the joining element is narrower than the cross section of the hollow chamber and that the joining element is joined via a tongue and groove connection to the hollow profiled slats.

Since the joining element in its cross section is narrower than the cross section of the hollow chamber into which it is inserted the support or adjustable chain links which overlap the joining element have a greater wall thickness than the Venetian blind slat itself without weakening of the Venetian blind slat occurring in this area.

The strong connection between the insert element and the Venetian blind slat in turn is produced by a profiled, form-fitted connection between the joining element and the Venetian blind slat so that the joining element is securely held in the Venetian blind slat, although its cross section is narrower than the hollow chamber cross section of the Venetian blind slat in which it is held.

Other features and advantages of the invention arise from the other subclaims and the following description of embodiments of the invention.

BRIEF DESCRIPTION OF THE DRAWINGS

FIG. 10 shows the cross section of a hollow profiled slat and FIGS. 11 through 18 shows another embodiment of the invention, FIG. 11 showing a Venetian blind slat.

FIG. 12 shows a support chain link,

FIG. 13 shows an adjustable chain link,

FIG. 14 a chain link of a center support chain,

FIG. 15 shows a joining element in the area of the adjustable chain,

FIG. 16 shows a joining element in the area of the center support chain,

FIG. 17 shows a facing part for the joining element of FIG. 15

FIG. 18 shows a facing part for the joining element of FIG. 16.

DESCRIPTION OF THE PREFERRED EMBODIMENTS

Figure 1:
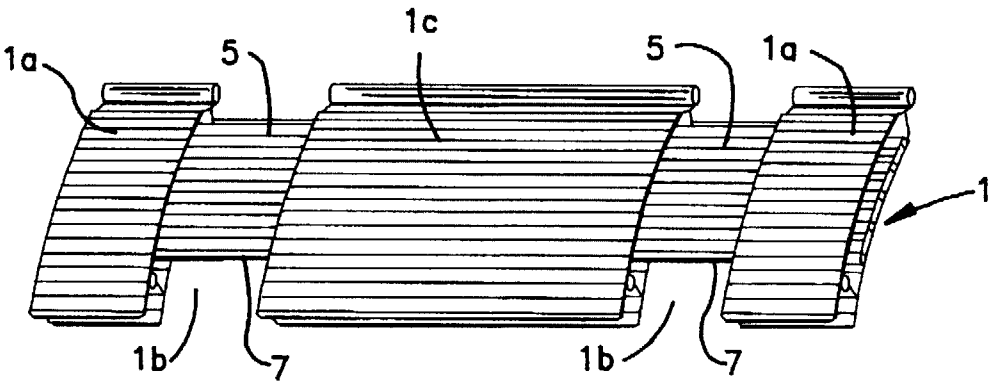
FIG. 1 shows one embodiment of a Venetian blind slat according to the invention.

FIG. 1 shows in a perspective representation an assembled Venetian blind slat 1 which consists of two edge parts 1*a* and center part 1*c*, with a length which depends on the total width of the Venetian blind. Edge parts 1*a* and center part 1*c* are joined by two joining elements 5 which are inserted into edge parts 1*a* and center part 1*c*, between edge parts 1*a* and center part 1*c* free spaces 1*b* being formed in which adjustable chain links are accommodated, as is shown in FIG. 3.

Figure 2:
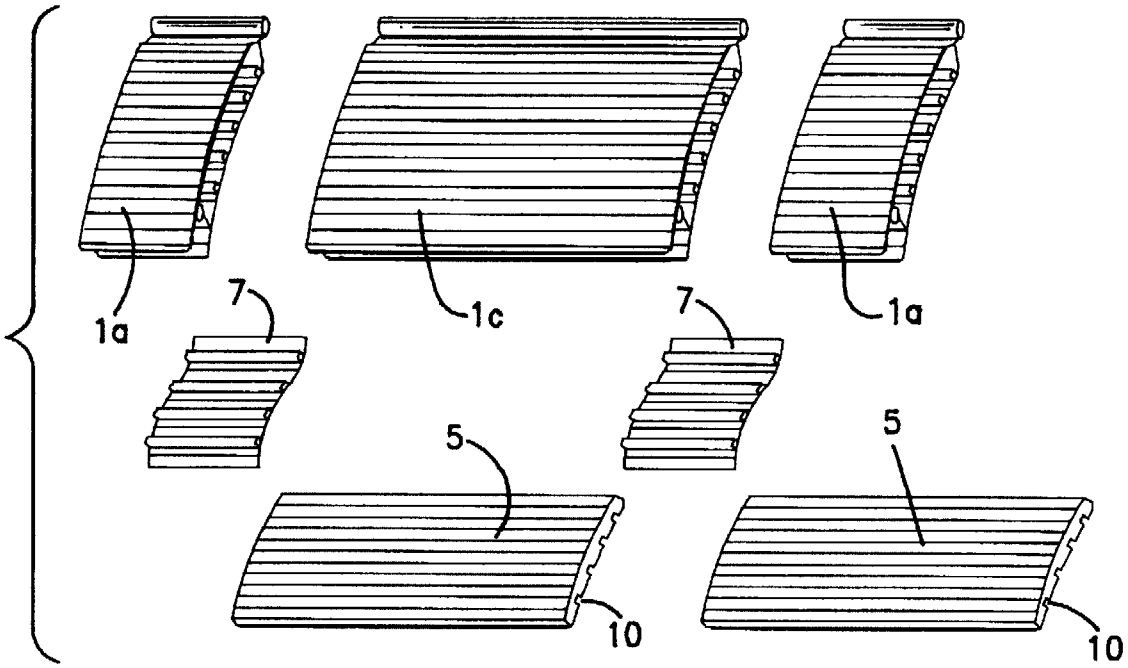
FIG. 2 shows the embodiment of FIG. 1 in an exploded view.
Figure 4:
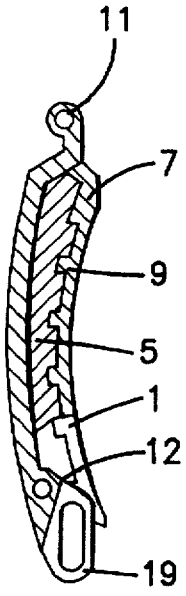
FIG. 4 shows a section through a Venetian blind slat of FIG. 3 along line IV—IV.
Figure 5:
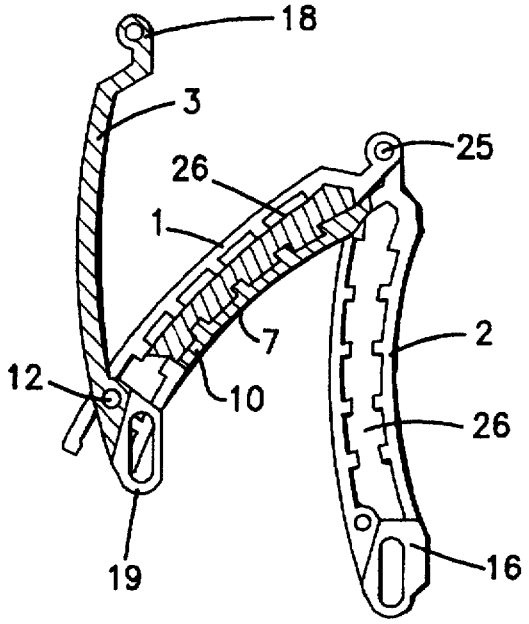
FIG. 5 shows a section through the Venetian blind slat according to FIG. 4, but which is partially opened.

FIG. 2 shows not only details 1*a*, 1*c* and 5, but also facing parts 7, which are attached to joining elements 5 in the area of recesses 1*b* on the back, i.e., the side facing the building interior so that Venetian blind slat 1 on its back in the area of joining elements 5 has a continuous surface (see also FIGS. 4 and 5).

All parts of Venetian blind slat 1 can be produced from extruded sections.

Figure 3:
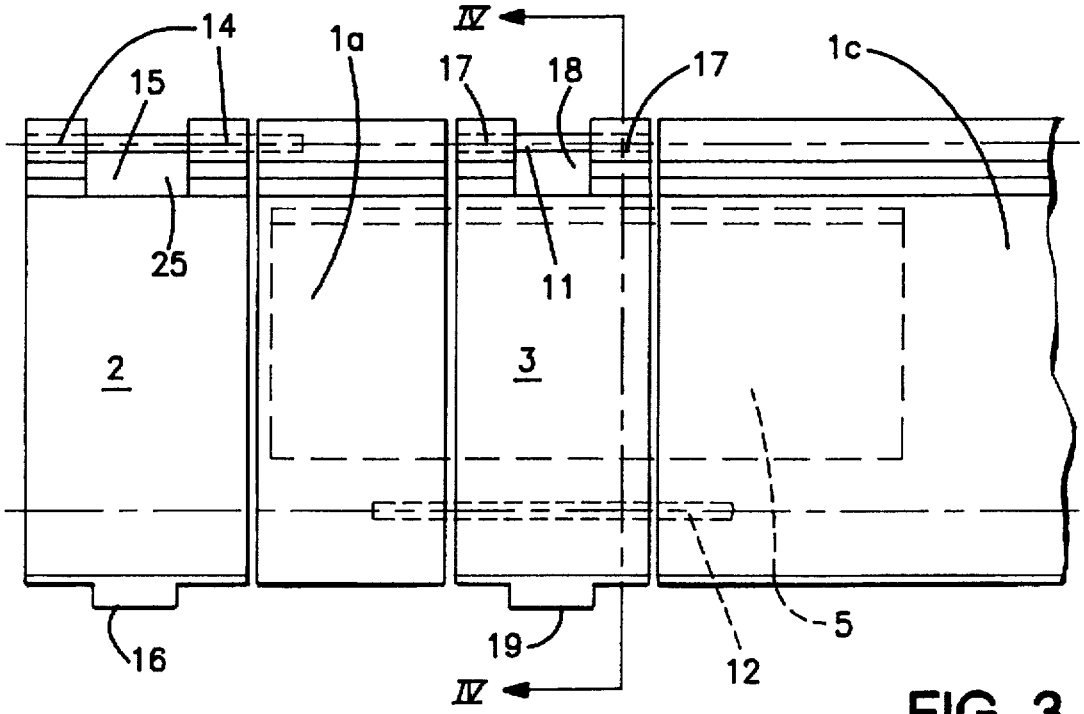
FIG. 3 shows a partial view of the Venetian blind slat of FIG. 1 with one support and one adjustable chain link.

FIG. 3 shows an overhead view of one end of Venetian blind slat in the assembled state. FIG. 3 shows that between parts 1*a* and 1*c* of Venetian blind slat 1 adjustable chain link 3 is held. Adjustable chain link 3 is joined via pin 12 (see also FIGS. 4 and 5) to parts 1*a*, 1*c* of Venetian blind slat 1. The hinged connection of adjustable chain links 3 among one another takes place via projections 19 with elongated eyes which are attached on the lower end of adjustable chain links 3 and which fit into recesses 18 between studs 17 on the top end of adjustable chain links 3 and are joined to the latter via hinge pins 11.

On the free end of outer part 1*a* there is support chain link 2 arranged such that it is hinged to part 1*a* via hinge pin 25. The hinged connection of support chain links 2 among one another takes place essentially like the connection of adjustable chain links 3 among one another, and for example via projection 16 with an elongated eye on the bottom end of support chain link 2 which fits into recess 15 between studs 14 of subsequent support chain link 2 and is fixed there via hinge pin 25.

Figure 9:
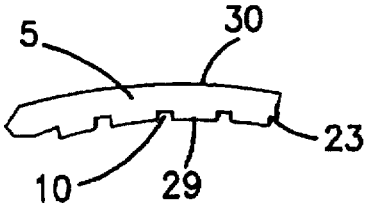
FIG. 9 shows a joining element for use in the area of an adjustable chain.
Figure 10:
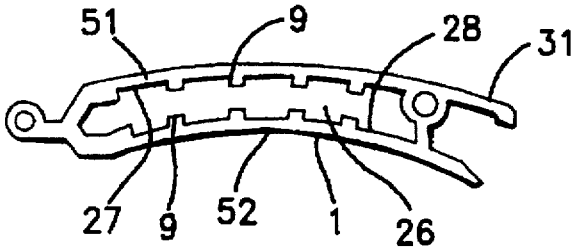

As is apparent for example in FIGS. 5 and 10, Venetian blind slat 1 has a hollow chamber 26 in which joining element 5 is accommodated. For a strong, form-fitted connection of joining element 5 to Venetian blind slat 1 front wall 51 and rear wall 52 on inside surfaces 27, 28 have dovetailed studs 9 which interact with the corresponding grooves 10 (FIG. 9) which are located on the inside, i.e., the side of joining element 5 facing the building interior. Opposite outer side 30 of joining element 5 is made smooth and joining element 5 with this outer side abuts only the free ends of studs 9. In this way outer side 30 of joining element 5 is spaced by roughly twice the 1' wall thickness 51 of Venetian blind slat 1 away from outer surface 31 of the latter and the cross section of joining element 5 is narrower than hollow chamber cross section 26 of Venetian blind slat 1. Based on this special configuration, as shown in FIGS. 4 and 5, adjustable chain link 3 for example can have twice the wall thickness of hollow profiled slat 1, by which its strength is greatly increased compared to one embodiment in which the joining element completely fills hollow chamber 26 in Venetian blind slat 1, by which the wall thickness of adjustable chain link 3 could then have only the wall thickness of Venetian blind slat 1. By means of the profiled, form-fitted connection of joining element 5 to Venetian blind slat 1 in the form of grooves 10 and studs 9 in turn a very strong connection between joining element 5 and hollow profiled slat 1 is ensured so that overall there is a connection which is much easier to manufacture compared to the prior art and which is still more supportive.

FIGS. 4 and 5 furthermore show that facing part 7 is likewise attached via stud and groove connection 9, 10 on joining element 5.

Figure 6:
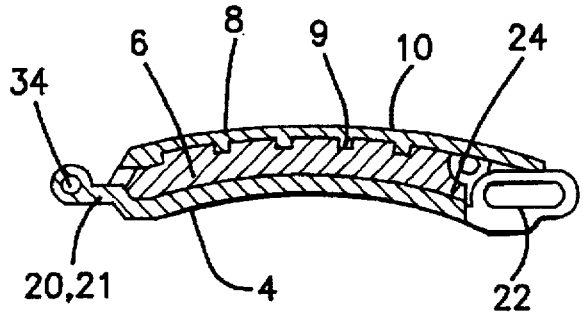
FIG. 6 shows a section through a Venetian blind slat in the area of center support chain.
Figure 7:
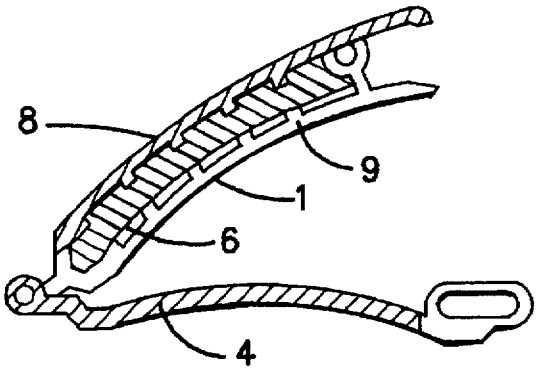
FIG. 7 shows the Venetian blind slat of FIG. 6 in the partially unfolded state.

FIGS. 6 and 7 show a cross section through a Venetian blind slat in the area of the center support chain which can be used for example in especially wide Venetian blinds and which can be arranged for example in the center of center part 1*c* of Venetian blind slat 1 which is shown in FIG. 1. The center support chain consists of chain links 4 which are arranged on the back of Venetian blind slat 1 in a recess according to recesses 1*b*.

Figure 8:
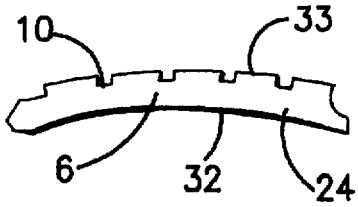
FIG. 8 shows a joining element for use in a center support chain.

Joining element 6 in this case is made such that back 32 is smooth and front 33 is provided with grooves 10 and is joined via dovetailed studs 9 to hollow profiled slat 1 (see also FIG. 8).

Center support chain link 4 like support chain link 2 on its lower end has projection 22 with an elongated eye and on its upper end recess 20 with two side studs 21 in which projection 22 of adjacent center support chain link 4 is accommodated and is hinged via pin 34.

In order that outer surface 31 of the Venetian blind slat is also made essentially smooth in the area of the center support chain, there is facing part 8 which is placed from the outside on joining element 6 and is joined via studs 9 to grooves 10 of the joining element.

As can be seen especially in FIG. 7, by means of the configuration of joining element 6 and the hollow chamber section of Venetian blind slat 1 according to the invention, the cross section of center support chain 4 can be roughly twice as thick as the cross section of rear wall 52 of Venetian blind slat 1 so that there can be very stable center support chain 4 in this area without weakening of Venetian blind slat 1.

As is still shown in FIG. 9, the lower end of joining element 5 is cut off straight (reference number 23) in order to ensure that extension 19 can swivel freely with the elongated eye of adjustable chain element 3.

In conjunction with FIGS. 11 through 18, another embodiment of the invention is shown in which the groove-like and stud-like connection between joining element 40, 41 and Venetian blind slat 1 is located in the area of the upper and lower longitudinal edge of joining element 40, 41. Joining element 40 on its upper and lower longitudinal edge has a projection or stud 42 which fits into groove 43 in hollow profiled slat 1 and thus establishes the location of joining element 40, 41 in hollow profiled slat 1. As can be seen in FIG. 11, outer surface 44 of joining element 40 is essentially offset backward relative to outer surface 45 of Venetian blind slat 1 so that adjustable chain link 3 shown in FIG. 13 can have a much greater wall thickness than Venetian blind slat 1.

The corresponding applies to joining element 41 which can be inserted in the area of a center support chain of chain links 4, and with a rear wall 46 which is highly offset backward relative to rear wall 47 of Venetian blind slat 1, i.e., by more than wall thickness 53 of Venetian blind slat 1, so that the wall thickness of center support chain link 4 can also be greater than the wall thickness of Venetian blind slat 1.

The advantage of the embodiment shown in conjunction with FIGS. 11 through 18 over the embodiment of the invention shown in FIGS. 1 through 10 is the much lower production tolerances. Also, because the profiled shape of joining elements 40, 41 and of the hollow profiled slat is simpler, the tools for producing the parts shown in FIGS. 11, 12 and 15, 16 are simpler and thus cheaper.

In order to cover the rear wall of joining elements 40 in the area of adjustable chain links 3' or to cover the front of joining elements 41 in the area of a center support chain, there are facing parts 48 and 49 which are shown in FIGS. 17 and 19 and which can be placed on studs 42 of joining elements 40, 41 via grooves and thus impart a more even appearance to the Venetian blind slat.

In the hollow section chamber of support chain link 2' shown in FIG. 12 joining element 40 is shown which is present only in special cases in those Venetian blind slats which can be located in the upper area of a Venetian blind and which are made not to be folded up. In these Venetian blind slats joining element 40 extends into support chain link 2' in order to create an especially stable Venetian blind slat. In other foldable Venetian blind slats 1' joining element 40 is not accommodated in support chain links 2'. The immediately aforementioned also applies to the embodiment shown in FIGS. 1 through 10.

On joining elements 40, 41 on their longitudinal edges there can be grooves and on hollow profiled slats 1 instead of grooves 43 there can be studs which fit into the grooves on joining elements 40, 41 and thus establish a form-fitted connection between these parts.

The shape of the grooves and studs is not limited to the forms shown in the drawings, but they can have any shape with which a profiled connection or interlocking is created between the joining elements and the Venetian blind slats to create a form-fitted connection between then, it being essentially irrelevant whenever at this point the grooves or recesses are located on the Venetian blind slats or the joining elements.

In summary the invention can be described for example as follows.

A Venetian blind has hollow profiled slats 1 in which between center part 1*c* and two edge parts 1*a* transversely to its longitudinal extension there are grooves 1*b* to accommodate support or adjustable chain links 3, 4. Edge parts 1*a* and center parts 1*c* are spaced away from one another and are joined to one another by means of joining elements 5, 6, 40, 41 which are inserted into hollow chambers 26 of hollow profiled slat 1. The cross section of joining elements 5, 6, 40 and 41 is narrower than the cross section of hollow chamber 26 and joining elements 5, 6, 40, 41 are joined to hollow profiled slats 1 via groove and stud connection 9, 10; 42, 43. In this way easily manufactured grooves 1*b* are created without weakening Venetian blind slat 1 in the area of grooves 1*b*.

We claim:

1. A venetian blind slat comprising:

a hollow profiled slat;

chain links;

grooves (1*b*) to hold said chain links (3, 4) transversely to its longitudinal extension;

a hollow chamber, having two parts;

one joining element (5, 6, 40, 41) for joining said two parts (1*a*, 1*c*) of said hollow profiled slat (1), said joining element being insertable into said hollow chamber (26);

said two parts (1*a*, 1*c*) of said hollow profiled slat (1) being spaced away from one another, said two parts and said joining element (5, 6, 40, 41) bordering said grooves (1*b*).

2. A venetian blind slat according to claim 1, wherein a cross section of said joining element (5, 6, 40, 41) is narrower than a cross section of said hollow chamber (26) and wherein said joining element (5, 6, 40, 41) is joined by a tongue and groove connection (9, 10; 42, 43) to the hollow profiled slat (1).

3. A venetian blind slat according to claim 1, wherein said hollow profiled slat has grooves, said joining element (40, 41) has upper and lower longitudinal edges, and said upper and lower longitudinal edges have studs (42), which fit into said grooves (43) in said hollow profiled slat (1).

4. A venetian blind slat according to claim 1, wherein said hollow profiled slat has studs molded thereon, and said joining element (40, 41) has upper and lower longitudinal edges, said upper and lower longitudinal edges have grooves into which fit said studs molded onto said hollow profiled slat (1).

5. A venetian blind slat according to claim 1, wherein said hollow chamber (26) of said hollow profiled slat has (1) on a front wall (51) and a rear wall (52) at least one groove or stud (9) cooperating with at least one stud or groove (10) on at least one of a front wall (30, 33) and a rear wall (29, 32) of said joining element (5, 6).

6. A venetian blind slat according to claim 5, wherein said joining element (5, 6) has studs (1) or grooves (10) only on one of said front wall (33) and said rear wall (29) and wherein another of said front and said rear wall is made essentially smooth.

7. A venetian blind slat according to claim 1, wherein at least one of a front (30, 44) and a rear wall (32, 46) of said joining element (5, 6, 40, 41) is spaced away from an inside surface of one of a front wall (51, 54) and a rear wall (52, 53) of said hollow profiled slat (1).

8. A venetian blind slat according to claim 1, wherein said chain links are one of support and adjustable chain links, and said joining element (5, 6, 40, 41) has facing parts on a side opposite one of support (4) and adjustable chain links (3).

9. A venetian blind slat according to claim 1, wherein said joining element (5, 6, 40, 41) is joined to said hollow profiled slat (1) by one of notch pressing and adhesive.

* * * * *